US006351906B1

(12) United States Patent
Honig, Jr. et al.

(10) Patent No.: US 6,351,906 B1
(45) Date of Patent: Mar. 5, 2002

(54) FIREARM AUTOMATIC LOCKING SYSTEM AND METHOD

(76) Inventors: Ernest M. Honig, Jr., 11730 Pebbleton Dr., Houston, TX (US) 77070; Kenneth J. Pugh, 5326 Spanish Oak, Houston, TX (US) 77066

( * ) Notice: Subject to any disclaimer, the term of this patent is extended or adjusted under 35 U.S.C. 154(b) by 0 days.

(21) Appl. No.: 09/434,698

(22) Filed: Nov. 5, 1999

(51) Int. Cl.[7] ..... F41A 17/06

(52) U.S. Cl. ..... 42/70.11; 42/70.11; 42/70.01; 42/70.06; 42/66

(58) Field of Search ..... 42/70.11, 70.01, 42/70.06, 66

(56) References Cited

U.S. PATENT DOCUMENTS

| | | | | | |
|---|---|---|---|---|---|
| 4,067,132 | A | | 1/1978 | Smith | 42/66 |
| 4,105,885 | A | | 8/1978 | Orenstein | |
| 4,110,928 | A | * | 9/1978 | Smith | 42/66 |
| 4,135,320 | A | * | 1/1979 | Smith | 42/70.11 |
| 4,154,014 | A | | 5/1979 | Smith | |
| 4,488,370 | A | | 12/1984 | Lemelson | |
| 4,563,827 | A | * | 1/1986 | Heltzel | 42/66 |
| 4,682,435 | A | | 7/1987 | Heltzel | 42/70.01 |
| 4,763,431 | A | * | 8/1988 | Allan et al. | 42/70.11 |
| 5,016,376 | A | | 5/1991 | Pugh | 42/70.11 |
| 5,062,232 | A | | 11/1991 | Eppler | 42/70.11 |
| 5,123,193 | A | | 6/1992 | Pugh | 42/70.11 |
| 5,168,114 | A | * | 12/1992 | Enget | 42/70.11 |
| 5,459,957 | A | * | 10/1995 | Winer | 42/70.11 |
| 5,564,211 | A | * | 10/1996 | Mossberg et al. | 42/70.11 |
| 5,758,524 | A | | 6/1998 | Yu | 70/276 |
| 5,808,550 | A | | 9/1998 | Raimbault et al. | 340/572 |

* cited by examiner

*Primary Examiner*—Michael J. Carone
*Assistant Examiner*—Lulit Semunegus
(74) *Attorney, Agent, or Firm*—Kenneth A. Roddy

(57) ABSTRACT

This invention is a firearm automatic locking system and method using an emitter that produces an alternating electromagnetic field to induce an eddy current in an encoder presented by an authorized user of the firearm. A sensor in the firearm detects a unique signature of the eddy current, which unique signature is based on any combination of the size, weight, composition and shape of the encoder, which is typically a ring worn by the authorized user. The eddy current signature is then compared electronically to a predetermined value. If the signature and value are equivalent, a power circuit is closed providing an electrical current to an electrical device, thereby mechanically enabling the firing mechanism of the firearm. As long as the encoder is in adequate proximity to the automatic locking system, the weapon can be fired. To conserve battery power, the automatic locking system is activated only when a magnetic reed switch is activated.

17 Claims, 8 Drawing Sheets

FIREARM AUTOMATIC LOCKING SYSTEM AND METHOD

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

This invention relates generally to an automatic locking system for preventing unauthorized firing of a firearm. The device uses an emitter for producing an alternating electromagnetic field, a target material inducing an eddy current, a sensor for identifying the unique signature of the target material and a comparator for producing a weapon lock release signal.

2. Background Information

One problem an owner of firearms often encounters is preventing the unauthorized use of the firearm. An example of such unauthorized use is a criminal firing a handgun wrested from a police officer during a scuffle. Another unauthorized use is a child firing an unlocked weapon.

A typical firearm includes a "safety." Often the safety is a slide or switch that uses a mechanical linkage to disable or lock the internal firing mechanism of the weapon. Such a safety mechanism normally protects only against unintended discharge, such as preventing the weapon from firing if the weapon is dropped. A problem with the mechanical switch is that anyone can disable such a safety mechanism.

BRIEF SUMMARY OF THE INVENTION

The present invention comprises a firearm automatic locking system and method including an emitter that produces an alternating electromagnetic field, the electromagnetic field inducing an eddy current in an encoder held by an authorized user of the firearm. A sensor in the firearm detects a unique signature of the eddy current, which unique signature is based on any combination of the size, weight, composition and shape of the encoder. The eddy current signature is then compared electronically to a predetermined value. If the signature and value are equivalent, a power circuit is closed providing an electrical current to a miniature motor or to an electrical solenoid, thereby mechanically enabling the firing mechanism of the firearm. As long as the encoder is in adequate proximity to the automatic locking system, the weapon can be fired, assuming any mechanical safety devices have been positioned to the firing position and the weapon is cocked and loaded. In a preferred embodiment, a magnetic reed switch is activated by a magnet to power up the automatic locking system. This magnetic reed switch is closed only when a magnet of appropriate strength is brought near the reed switch.

DETAILED DESCRIPTION OF THE INVENTION

Figure 1:
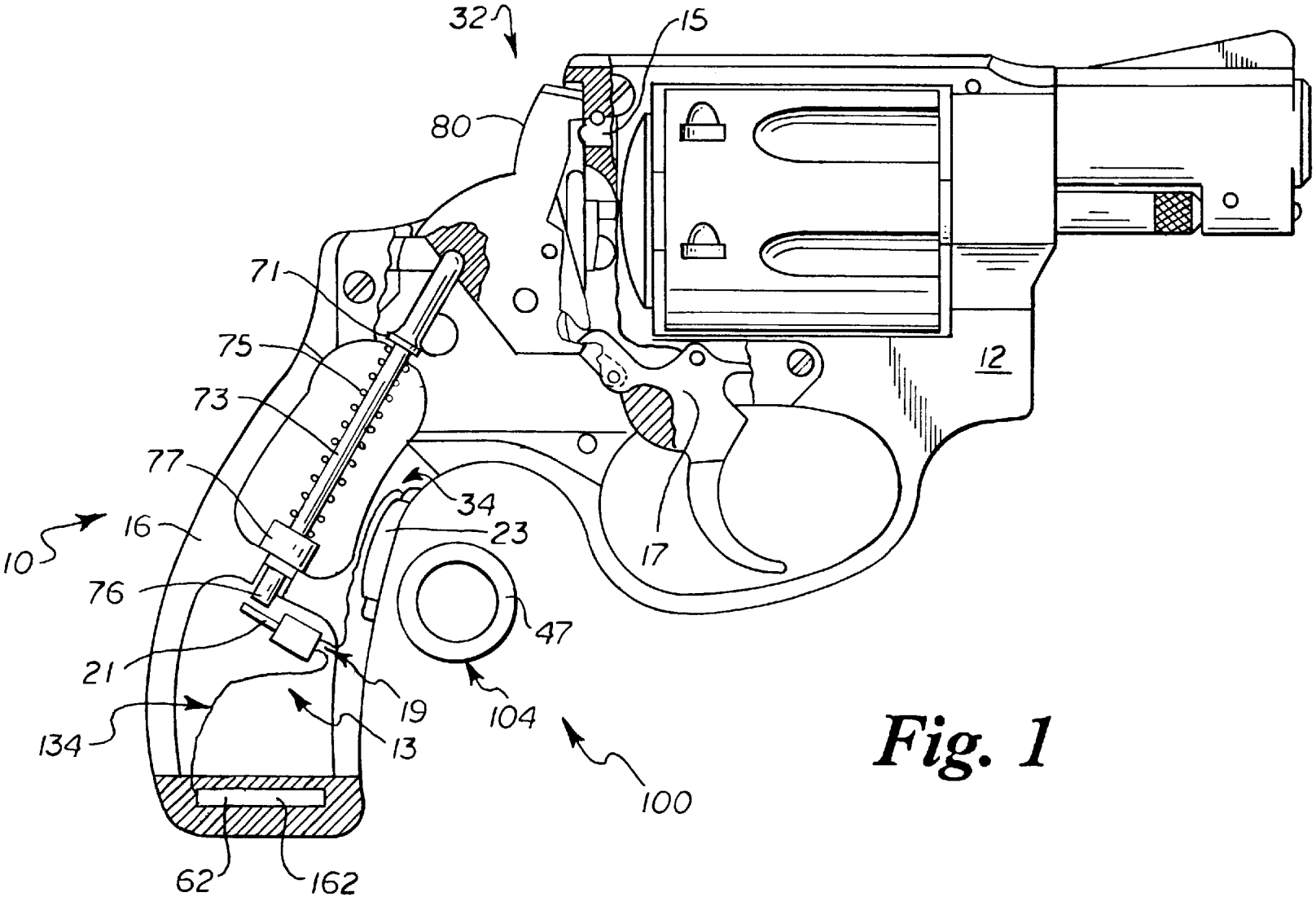
FIG. 1 depicts a cut-away view of a handgun and the automatic locking system of a preferred embodiment of the present invention.

Referring to FIG. 1, the preferred embodiment of automatic locking system 10 of the present invention is depicted in relation to firearm 12. In the preferred embodiment, automatic locking system 10 comprises power initiator means 23, verification system 100 and enabling mechanism 13.

As a background of the environment of automatic locking system 10, FIG. 1 depicts a typical firing means 32 of firearm 12. In normal operation (without the present invention or with the present invention in a state allowing the firing of firearm 12), hammer 80 is pulled back either physically by the user or mechanically through linkage in a double action firing means (details not shown). Hammer spring guide 73, which provides tension to hammer 80, is interposed to hammer spring 75. Hammer spring 75 extends axially between hammer spring guide flange 71 and hammer spring guide collar 77. As hammer 80 is pulled back, hammer spring 75 is compressed, affording compression potential energy to hammer 80 through hammer spring guide 73. Hammer 80 is pulled back until it is fully cocked, and then is released by trigger linkage 17 (details not shown). When hammer 80 is released, it strikes firing pin 15 with sufficient velocity to cause firing pin 15 to discharge a cartridge (not shown).

Enabling mechanism 13 comprises in the preferred embodiment a miniature electric stepping motor 19 and motor piston 21, as depicted in FIG. 1. Motor piston 21 is mounted inside handle 16 proximate to hammer spring guide 73. In the "locked" state of automatic locking system 10, motor piston 21 is proximate hammer spring guide distal end 76. Hammer spring guide 73 is thus blocked, hammer 80 can not cock and firing means 32 is disabled.

To enable firing means 32, electrical current from power source 162 is applied to enabling mechanism 13, which in the preferred embodiment is miniature electric stepping motor 19. Activation of miniature electric stepping motor 19 causes motor piston 21 to be orthogonally retracted away from hammer spring guide distal end 76, thus allowing free axial movement of hammer spring guide 73. With this free movement of hammer spring guide 73, hammer 80 can be cocked through the compression of hammer spring 75. Assuming the mechanical trigger safety, if any, is "off safe," hammer 80 can subsequently be released by trigger linkage 17, thus causing the striking of firing pin 15 to discharge weapon 12.

The enabling means described above through the movement of motor piston 21 is controlled by application of power from power source 162 to miniature electric stepping motor 19. This application of power is controlled by verification system 100, depicted in FIG. 1 and FIG. 6 as being mounted in handle 16, and depicted in block diagram form in FIG. 2. In an alternative embodiment (not shown), verification system 100 can be integral to a removable or attachable part of weapon 12. Such parts could include an ammunition clip, handgrips or other attachments modified to be capable of electrical communication with the enabling means.

Verification system 100 includes an encoder means, a decoder means and an output means for providing the power to miniature electric stepping motor 19.

The encoder means includes emitter 102 and encoder 104.

Emitter 102 generates alternating electromagnetic field 106 with constant or variable frequency.

Encoder 104 is a material capable of conducting electrical eddy current 109, which is induced by alternating electromagnetic field 106. Typically, encoder 104 is a ring or pendant, usually metallic, worn by an authorized user of firearm 12.

The decoder means includes eddy current sensor 108, digital comparator 112 and storage device 110. Eddy current sensor 108 is an electromagnetic field sensor that detects and measures eddy current 109 by measuring changes in alternating electromagnetic field 106 caused by eddy current 109 in encoder 104. The measured changes are relatively small compared to alternating electromagnetic field 106. Therefore, eddy current sensor 108 includes a nulling coil (not shown), which provides a nulling signal 180° out of phase of the signal from emitter 102, thus canceling out the carrier frequency of emitter 102. Eddy current sensor 108 performs in phase demodulation to detect amplitude changes in alternating electromagnetic field 106 and quadrature (phase shifted 90°) demodulation to detect phase changes in alternating electromagnetic field 106. The amplitude change and phase shift depend on the size, shape and/or composition of encoders 104. These values are digitized using an electronic analog-to-digital converter (ADC). The output of the ADC is input to digital comparator 112. Digital comparator 112 compares the digital output of eddy current sensor 108 with a predetermined digital value stored in storage device 110, typically a non-volatile semiconductor memory. In the preferred embodiment, storage device 110 is a microchip having an electronically programmable read-only memory incorporated in the circuit of the device.

If the digitized output of eddy current sensor 108 has the same value as that stored in storage device 110, then the output means of verification system 100 is enabled. The output means is effected by closing electronic power switch 150, completing circuit 134, thus allowing electrical current to flow from power source 162, typically a battery, to the enabling mechanism 13 comprising miniature electric stepping motor 19. Activation of miniature electric stepping motor 19 causes motor piston 21 to be moved away from hammer spring guide distal end 76, allowing hammer 80 to be cocked and firearm 12 fired. In both the actuating and de-actuating of miniature electric stepping motor 19, miniature electric stepping motor 19 has a micro-limiting switch that turns off power to miniature electric stepping motor 19 when fully actuated or de-actuated.

Figure 6:
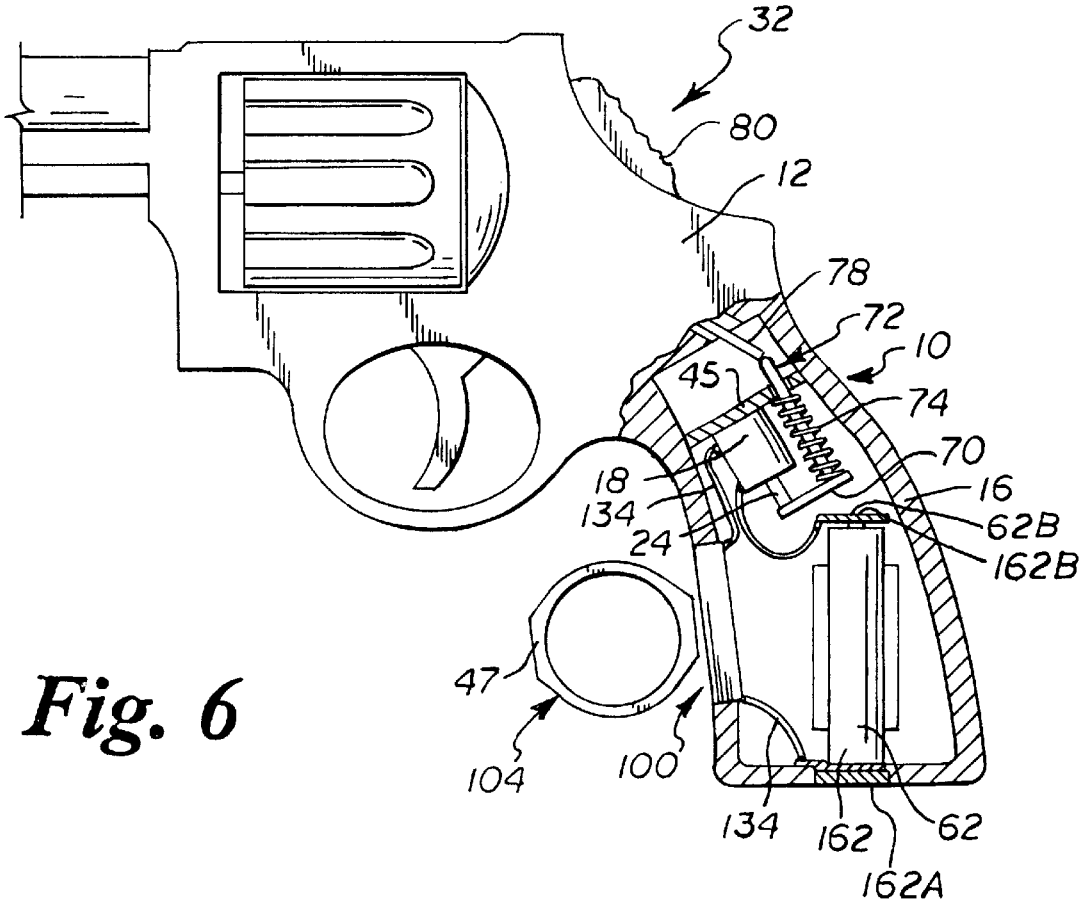
FIG. 6 depicts a cut-away view of a gun handle and the automatic locking system of an alternative embodiment of the automatic locking system.

In an alternative embodiment, enabling mechanism 13 comprises electrical solenoid 18, as depicted in FIG. 6. Solenoid arm 24 is connected to a connecting arm lever 70. Lever 70 engages push rod 72. A coil spring 74 extends between lever 70 and a base element 45. Base element 45 is fixedly attached to handle 16. Alternatively, base element 45 comprises a wall of a hollow section of handle 16. Spring 74 is biased between lever 70 and base element 45. Push rod 72 extends axially within spring 74 between lever 70 and linkage 78. Linkage 78 engages hammer 80. Spring 74 normally biases lever 70 away from base element 45. Upon activation of electrical solenoid 18, solenoid arm 24 is retracted into electrical solenoid 18 thereby compressing spring 74 and biasing push rod 72 and linkage 78 toward hammer 80 to effectively block firing of the firearm. The mechanics of attachment of linkage 78 to effectively prevent firing of the firearm would be determined by the specific make or model of weapon incorporating the present automatic locking system 10.

When encoder 104 is removed, electronic power switch 150 opens. A secondary circuit (not shown) reverses the direction of miniature electric stepping motor 19, causing motor piston 21 to move proximate to hammer spring guide distal end 76, thus blocking hammer spring guide 73, preventing hammer 80 from cocking. When hammer 80 is released or uncocked, hammer spring guide 73 retracts and motor piston 21 is repositioned to block hammer spring guide 73.

In the preferred embodiment, verification system 100 is activated only upon activation of power initiator means 23. Power initiator means 23 detects a primary signal indicating an authorized user (not shown). A form of signal comprising a magnetic field is described in this inventor's prior U.S. Pat. Nos. 5,016,376 and 5,123,193.

Figure 3:
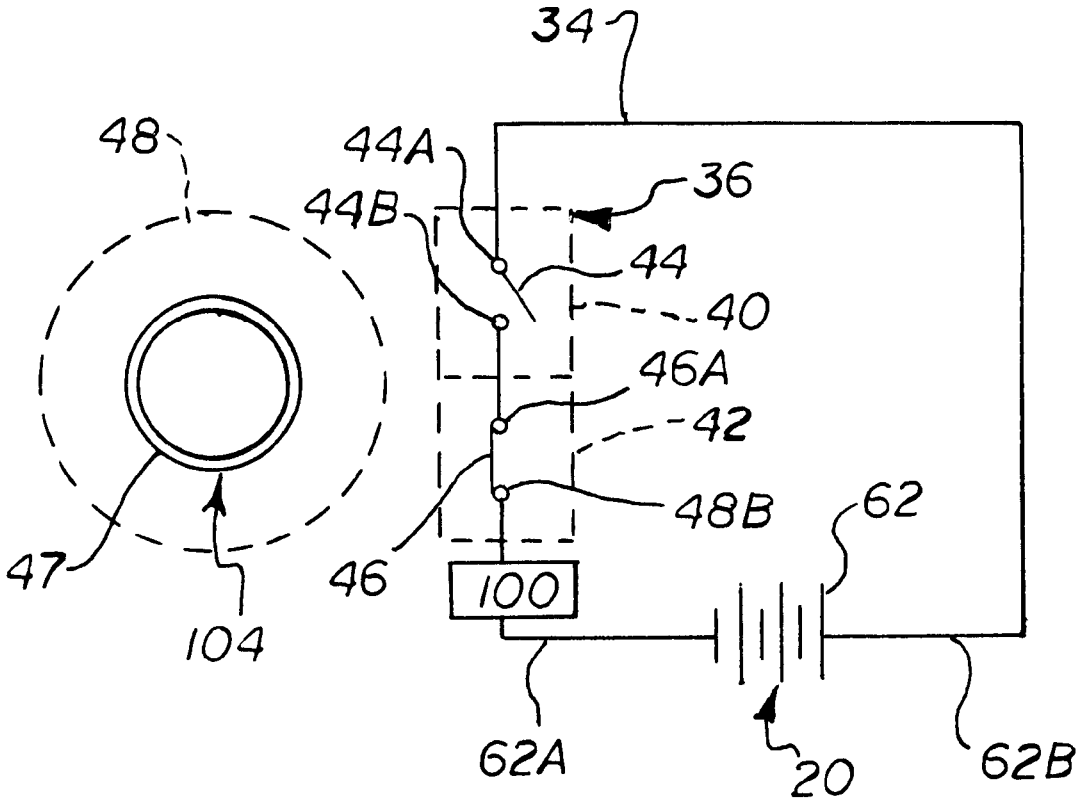
FIG. 3 depicts an block schematic of the preferred embodiment of the power initiator means.

The power initiator means 23 of the present invention is depicted in FIG. 3. The power initiator means 23 includes a magnetically actuated switch block 36 for opening or closing the electrical circuit 34.

Figure 2:
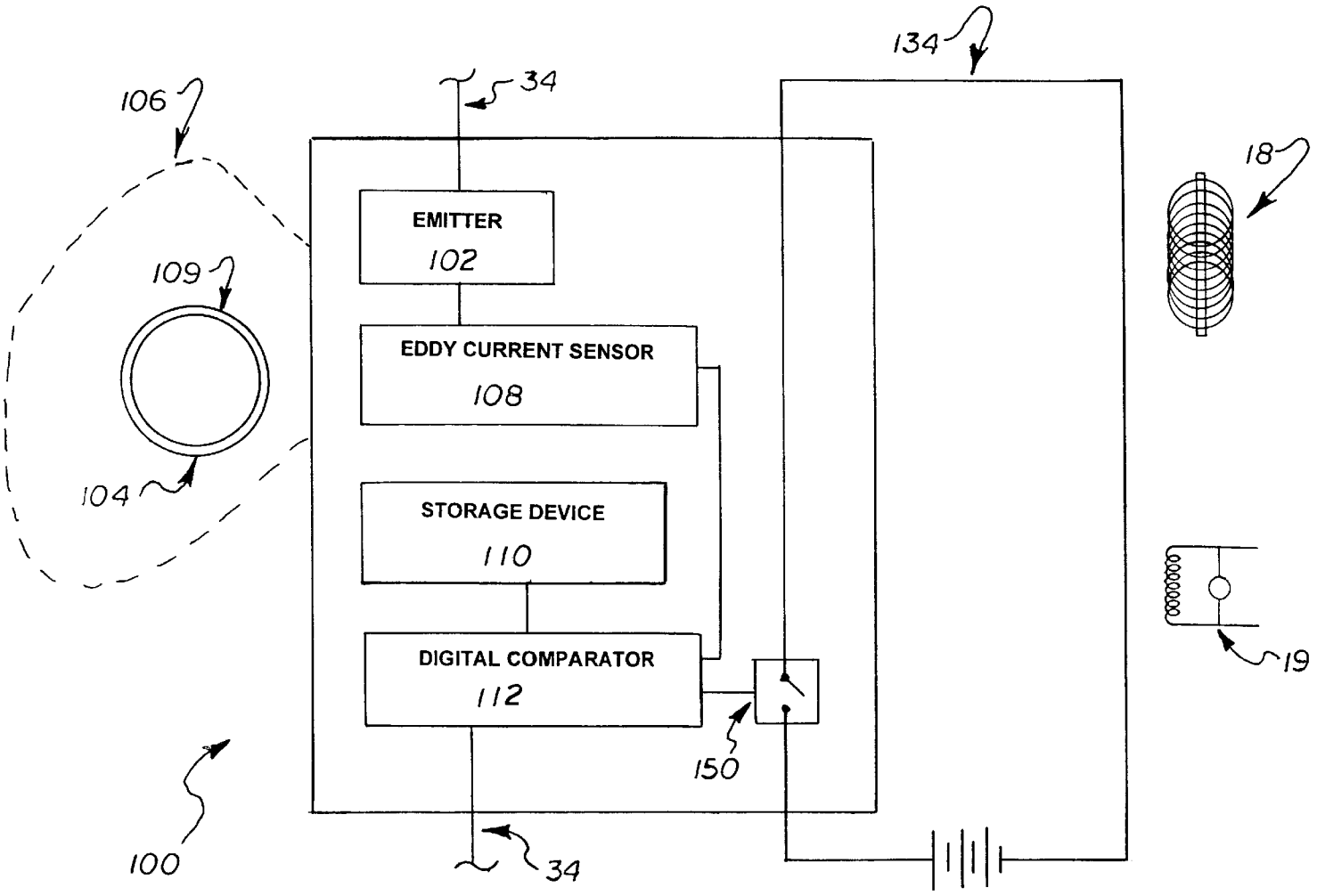
FIG. 2 depicts a block schematic of the eddy current inducer/sensor, encoder and firing enabling mechanism of the preferred embodiment of the invention.

The decoder includes a first known magnetically actuated switch 40 and a second known magnetically actuated switch 42. Switches 40 and 42 are electrically connected in series. First switch 40 includes a magnetically operable arm 44 and terminals 44*a* and 44*b*. First switch 40 is shown as open in FIG. 2. Second switch 42 includes a magnetically operable switch arm 46 and terminals 46*a* and 46*b*. Second switch 42 is shown in FIG. 2 as being in the normally closed position.

When a magnetic field 48 from magnet 47 is moved into the proximity of the power initiator means 23, a minimum strength or level of the field is required to magnetically operate switch arm 44 to close first switch 40. If the intensity of the magnetic field is sufficiently strong, the magnetic field will activate switch arm 46 to open switch 42 and thereby open circuit 34. Accordingly, a magnetic field 48 of sufficient strength will close electrical circuit 34, but a magnetic field 48 that is too strong will open the electrical circuit 34.

Power supply 20 generally comprises a battery 62 having terminals 62*a* and 62*b*. Power initiator means 23 is used as a power supply activation means for a verification system 100. When power initiator means 23 detects the proper strength magnet, electrical power from power supply 20 is delivered to verification system 100, which controls enabling mechanism 13.

This preferred embodiment allows power to be conserved by using power initiator means 23 as a power switch. In an alternative embodiment, verification system 100 can operate independently and without power initiator means 23, and remain in a power-up mode being directly connected to power source 162. In another alternative embodiment, verification system 100 can operate independently and without power initiator means 23, and an alternate electronic power switch, comprising those known in the art comprising mechanical, photoresistive, thermoresistive or chemical based devices, may perform the same function and be known as a power initiator means by completing the connection between verification system 100, enabling mechanism 13 and power source 162. In another alternative embodiment, power initiator means 23 can function as verification system 100 if verification system 100 is inoperable.

Figure 4:
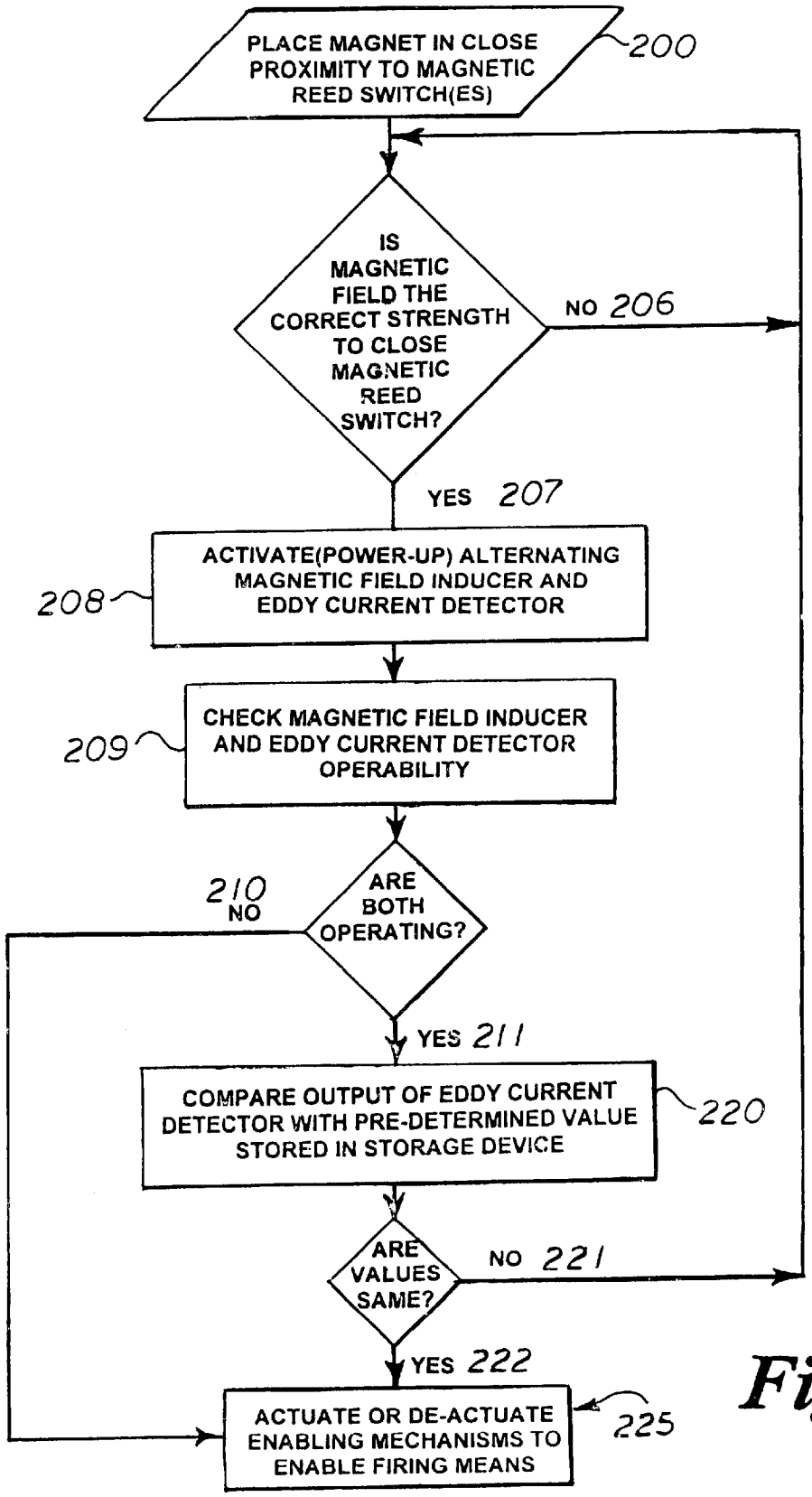
FIG. 4 depicts a flowchart of the method of the present invention.

FIG. 4 depicts in block form the operation of verification system 100 in the preferred embodiment. When a magnetic object, such as magnet 47 of encoder 104, is brought into proximity with magnetically actuated switch block 36 (event 200), magnetically actuated switch block 36 either remains open (condition 206) and verification system 100 remains disabled, or it closes, completing circuit 34 (condition 207), which activates (event 208) verification system 100. As described above, verification system 100 comprises emitter 102, encoder 104, sensor 108, storage device 110, digital comparator 112 and electronic power switch 150. Verification system 100 is tested (event 209) for operability. If non-operable (condition 210), verification system 100 is bypassed by an electrical circuit not shown, and firing means 32 is enabled (event 225). If verification system 100 is operable (condition 211), then the output of eddy current sensor 108 is compared with a pre-determined value stored in storage device 110 (event 220). If the values compared are not equivalent (condition 221) within a pre-determined range, then power initiator means 23 will re-evaluate the proximate presence of magnet 47 to restart the sequence of events. If the values compared are equivalent (condition 222) within a pre-determined range, then enabling mechanism 13 is actuated or deactuated (event 225) to enable firing means 32.

If the magnet 47 is removed from proximity of the power initiator means 23, switch block 36 is opened and firing means 32 is disabled.

In a preferred embodiment, the encoder 104 belonging to an authorized user of the firearm 12 consists of two or more materials; at least one of which is magnet 47. The proper magnetic material in encoder 104 activates power initiator means 23, which allows electrical power to communicate to verification system 100. The total composition of encoder 104 conducts a unique eddy-current signature, which is detected by sensor 108.

Forms of the encoder 104 may include a finger ring, an attachment to a finger or hand, or an attachment to an article of clothing. The encoder materials are known by kind [e.g., copper, silver], and/or amount [weight], and/or shape. The interaction of the encoder 104 with the electromagnetic signal emitted by the emitter 102 is determined and recorded in storage device 110, preferably during the manufacturing process.

The interaction of the encoder 104 with automatic locking system 10 is dependent on proximity of the encoder 104 with automatic locking system 10. In a preferred embodiment, the electromagnetic field 106 is of limited strength such that the interaction of electromagnetic field 106 with encoder 104 is not sufficient to provide a signature allowing closing of electrical circuit 34 if the encoder 104 exceeds a predetermined distance from the automatic locking system 10.

It is anticipated that automatic locking system 10, including encoder 104, will be marketed as an integral automatic locking system.

For operation of firearm 12 under the preferred embodiment of the invention, an authorized user places encoder 104 in alternating electromagnetic field 106 of verification system 100. Such placement may be as simple as gripping handle 16 of firearm 12 with a hand having ring encoder 104 on a finger of the gripping hand. Upon proximity of encoder 104 with electromagnetic field 106, electrical eddy current 109 in encoder 104 is induced. This current is measured by sensor 108. Digital values of such currents are assigned by sensor 108. Such digital values are compared with digital values that have been predetermined for the specific encoder 104 of the authorized user and are stored in microelectronic storage device 110. Digital comparator 112 compares the digital values of eddy current 109 detected by sensor 108 with the predetermined range of values stored in microelectronic storage device 110. If the values are equivalent within predetermined ranges, digital comparator 112 outputs a signal to close electronic power switch 150, thus completing circuit 134. Circuit 134 provides power from power source 162 via terminals 162*a* and 162*b* to electrical solenoid 18, thereby enabling firing means 32. If the digital values of eddy current 109 detected by sensor 108 are not within a predetermined range, electronic power switch 150 does not close electrical circuit 134 and firearm 12 is not operable.

Figure 5:
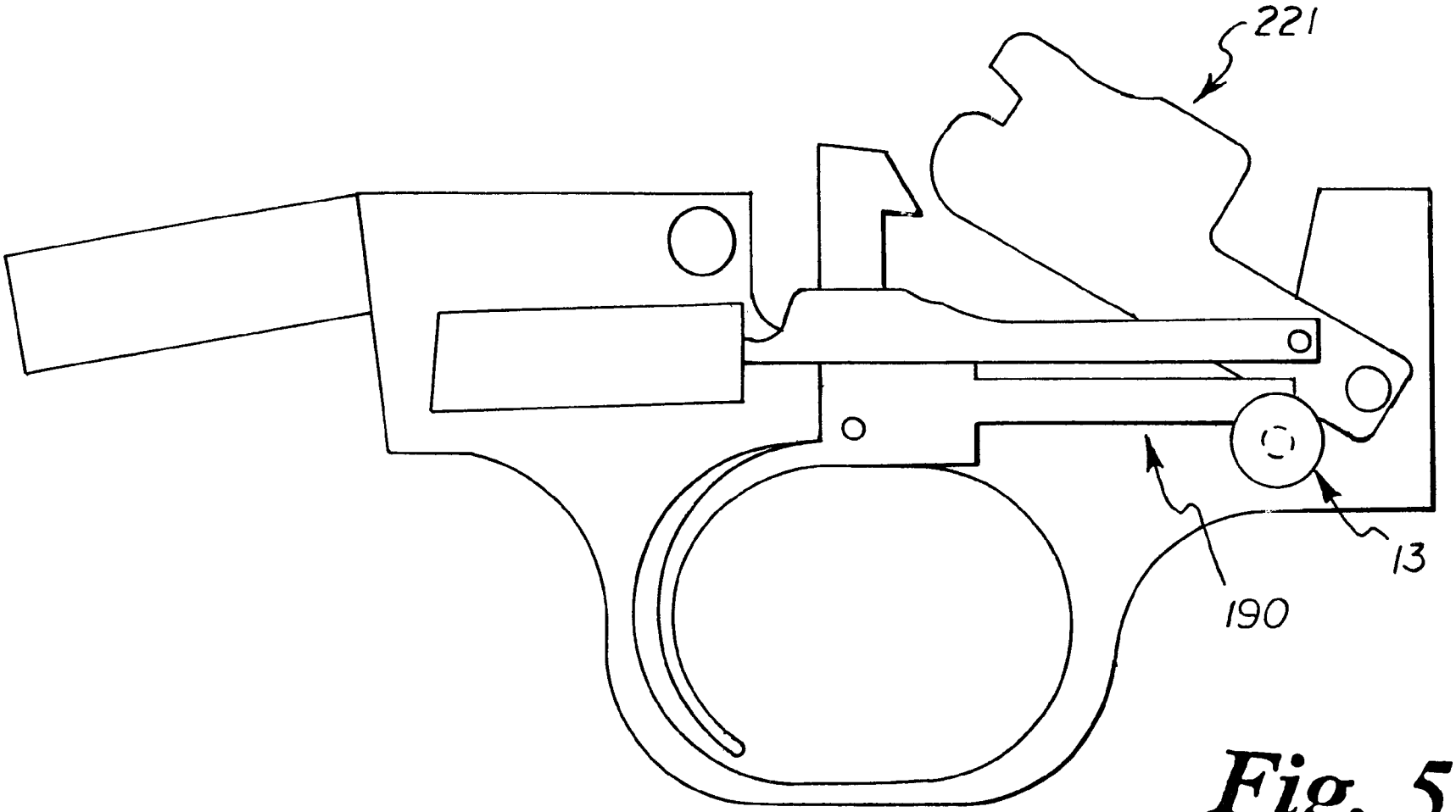
FIG. 5 depicts an alternative embodiment of the placement of the firing means disabling/enabling means.

While enabling mechanism 13 is depicted in FIG. 1 and FIG. 5 in the handle of firearm 12, enabling mechanism 13 associated linkage may be positioned in any of several locations in a firearm where activation of the electrical solenoid will enable/disable the firing means or operation of the weapon. Said operation disablement may restrict cartridge cylinder movement, block a trigger or otherwise interfere with the firing operation of a weapon. For example, FIG. 5 depicts placement of enabling mechanism 13 proximate to the trigger 190. When enabling mechanism 13 receives an authorization signal from verification system 100, enabling mechanism 13 is actuated allowing free movement of trigger 190. This free movement allows user to pull trigger 14 thus enabling firing means 32, including hammer 80. The alternative placement of enabling mechanism 13 shown in FIG. 5 would be appropriate in embodiments described for automatic locking system 10, including aftermarket installation on shoulder mounted firearms.

Figure 7:
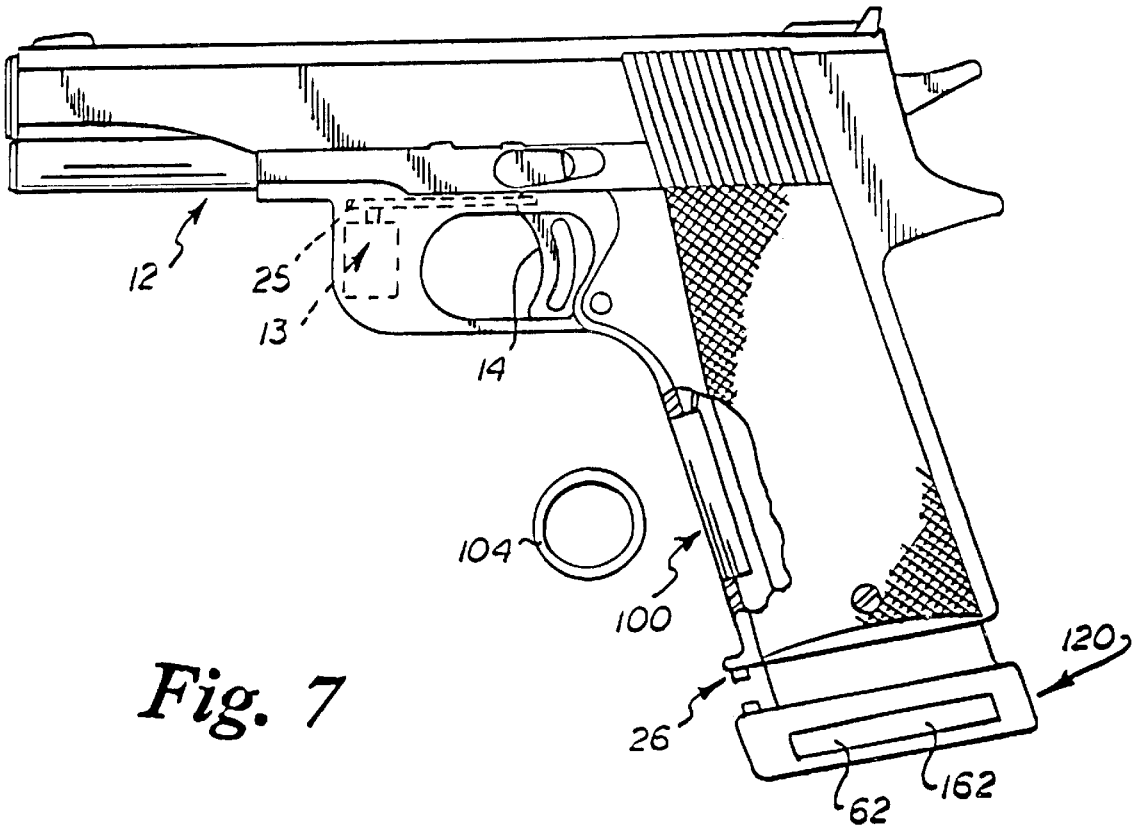
FIG. 7 depicts an alternative embodiment of the placement of the firing means disabling/enabling means in a semi-automatic pistol.
Figure 8:
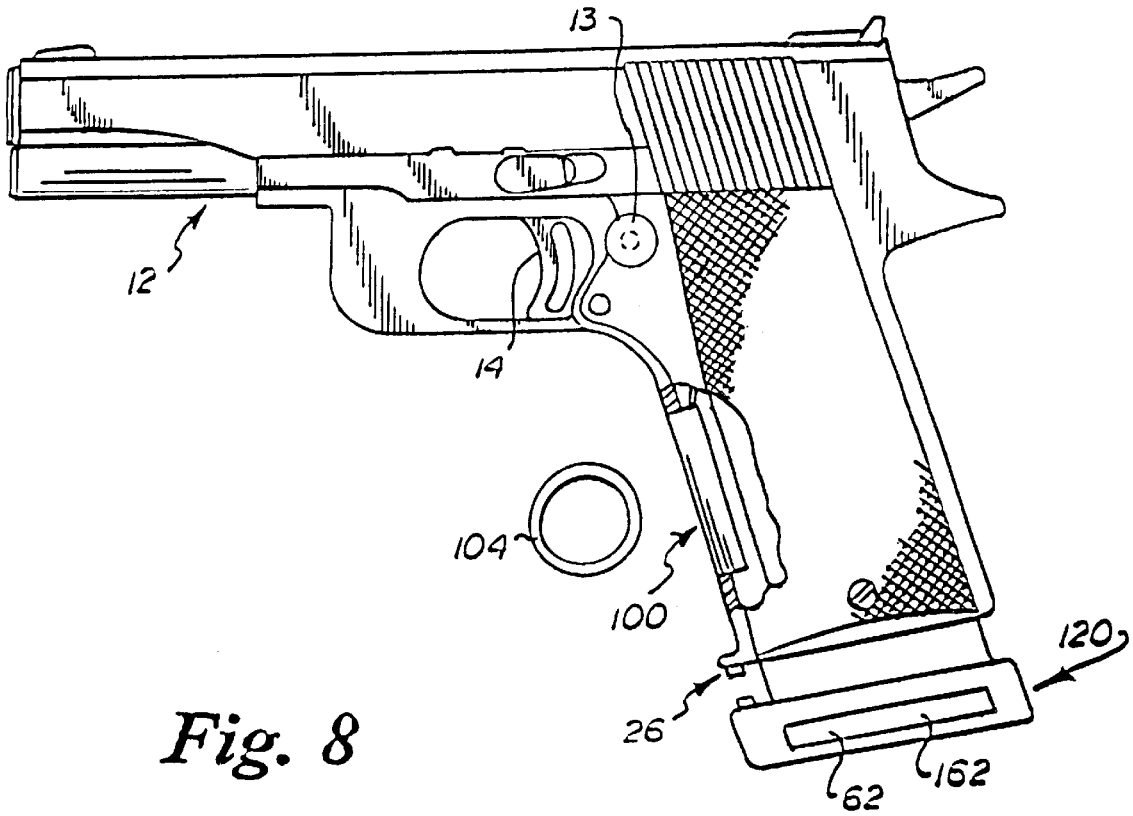
FIG. 8 depicts an alternative embodiment of the placement of the firing means disabling/enabling means in a semi-automatic pistol.

FIG. 7 depicts an alternative embodiment of verification system 100. Enabling mechanism 13 is connected to trigger block linkage 25, which is connected to trigger 14. Upon enablement by means described above by verification system 100, enabling mechanism, preferably electrical solenoid 18 or miniature electric stepping motor 19, releases and enables trigger 14 to be pulled. FIG. 8 depicts a similar embodiment, except enabling mechanism 13 is located directly behind trigger 14, and allows trigger 14 to be pulled upon activation of enabling mechanism by verification system 100. FIG. 7 and FIG. 8 further depict an alternative embodiment of battery 62 and power source 162 located in clip base 120 of an ammunition clip. Electrical communication between battery 62 and/or power source 162 is afforded by electric contacts 26, shown in FIG. 7 and FIG. 8 in a preferred position on firearm 12.

While FIG. 7 and FIG. 8 show alternative embodiments of placement of enabling means 13 on a semi-automatic pistol, these alternative embodiments are appropriate in any weapon having trigger 14 or a like mechanism. Likewise, the inclusion of battery 62 and/or power source 162 in a clip is illustrative only. Battery 62 and/or power source 162 may also be removable from weapon 12 by means of any temporary or semi-permanent attachment affording electric contacts 26 to verification system 100.

In the preferred and alternative embodiments of automatic locking system 10, firing means 32 is disabled if battery 62 is missing or has a low voltage. Therefore, a low voltage signal system (not shown) may be provided in relation to battery 62 according to known art to indicate low voltage status of battery 62.

The foregoing disclosure and description of the invention is illustrative and explanatory thereof. Various changes in the details of the illustrated construction may be made within the scope of the appended claims without departing from the spirit of the invention. The present invention should only be limited by the following claims and their legal equivalents.

I claim:

1. An automatic locking system for preventing unauthorized firing of a weapon of the type having a trigger and mechanical firing means for firing the weapon, the invention comprising:

an enabling means for controllably actuating or deactuating upon the application of an electrical enabling signal;

a magnetic field recognition system comprising an encoder means, a decoder means and an output means for generating said electrical enabling signal;

said encoder means for creating an authorization signal;

said decoder means for detecting said authorization signal and selectively activating said enabling means;

said decoder means comprising an electrical eddy current sensor;

said encoder means comprising an alternating electromagnetic field emitter and a proximately located material capable of conducting an electrical eddy current induced by an alternating electromagnetic field induced by said alternating electromagnetic field emitter; and a linkage means connecting the enabling means and the firing means for controllably enabling or disabling said firing means upon the desired activation of the enabling means.

2. A automatic locking system as in claim 1, further comprising:

a power initiator means;

said power initiator means activating and deactivating said magnetic field recognition system.

3. A automatic locking system as in claim 2, wherein:

said power initiator means including means to electrically test said decoder means' operational capability.

4. A automatic locking system as in claim 3, wherein said power initiator means includes a secondary electrical switching means for said desired activation of said enabling means if said decoder means fails said operational capability test.

5. An automatic locking system as in claim 4, wherein said secondary electrical switching means comprises at least one magnetically actuable switching means.

6. An automatic locking system as in claim 2, wherein said power initiator means comprises at least one magnetically actuable switching means.

7. A automatic locking system as in claim 2, wherein:

said power initiator means comprising at least two magnetically actuable switch means comprising a first magnetic switch and a second magnetic switch, said at least two magnetically actuable switch means electrically connected in series for opening or closing an electrical circuit;

said first magnetic switch remaining normally closed unless actuated by a magnetic field having a strength above a desired first level;

said second magnetic switch remaining normally open unless actuated by a magnetic field having strength above a desired second level;

whereby said power initiator means selectively activates or deactivates said decoder means upon detecting a magnetic encoder means having a selected range of magnetic field strengths.

8. An automatic locking system as in claim 2, wherein said power initiator means comprises a mechanical electric switch.

9. An automatic locking system as in claim 2, wherein said power initiator means comprises a photoresistive electric switch.

10. An automatic locking system as in claim 2, wherein said power initiator means comprises a thermoresistive electric switch.

11. An automatic locking system as in claim 2, wherein said power initiator means comprises a chemical based electric switch.

12. A automatic locking system as in claim 1, wherein:

said decoder means comprising an electronic comparator that compares a value of an electrical output means of the eddy current proximity sensor with a predetermined reference value; and said decoder enables said enabling means if said electrical output means and said predetermined reference value are equivalent within predetermined limits.

13. An automatic locking system as in claim 1, wherein said decoder means is mounted with said weapon.

14. An automatic locking system as in claim 1, wherein said decoder means is mounted within a removable ammunition clip.

15. An automatic locking system as in claim 1, wherein said enabling means includes an enabling mechanism.

16. An automatic locking system as in claim 15, wherein said enabling mechanism includes a miniature electric stepping motor.

17. An automatic locking system as in claim 15, wherein said enabling mechanism includes an electrical solenoid.

* * * * *